US010227123B1

(12) United States Patent
Araki et al.

(10) Patent No.: US 10,227,123 B1
(45) Date of Patent: Mar. 12, 2019

(54) PERSONAL WATERCRAFT

(71) Applicant: KAWASAKI JUKOGYO KABUSHIKI KAISHA, Kobe-shi, Hyogo (JP)

(72) Inventors: Toshio Araki, Kakogawa (JP); Hideaki Ebisui, Kobe (JP); Kenichi Okita, Kakogawa (JP); Kazuma Komura, Himeji (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 0 days.

(21) Appl. No.: 16/023,528

(22) Filed: Jun. 29, 2018

Related U.S. Application Data

(63) Continuation-in-part of application No. 15/692,710, filed on Aug. 31, 2017, now Pat. No. 10,040,518.

(51) Int. Cl.
*B63H 11/11* (2006.01)
*B63H 11/04* (2006.01)
*B63B 35/73* (2006.01)

(52) U.S. Cl.
CPC ..... *B63H 11/11* (2013.01); *B63B 35/731* (2013.01); *B63H 11/04* (2013.01)

(58) Field of Classification Search
CPC ..... B63H 11/04; B63H 11/11; B63B 35/731
See application file for complete search history.

(56) References Cited

U.S. PATENT DOCUMENTS

| | | | | |
|---|---|---|---|---|
| 5,062,815 | A | 11/1991 | Kobayashi | |
| 10,040,518 | B1 * | 8/2018 | Matsuda | B63B 35/731 |
| 2012/0077394 | A1 | 3/2012 | Banks et al. | |
| 2015/0239541 | A1 | 8/2015 | Anma | |
| 2016/0039505 | A1 | 2/2016 | Okamoto et al. | |

FOREIGN PATENT DOCUMENTS

JP 2014024534 A 2/2014

* cited by examiner

*Primary Examiner* — Stephen P Avila
(74) *Attorney, Agent, or Firm* — Alleman Hall Creasman & Tuttle LLP

(57) ABSTRACT

A personal watercraft includes a rider operation member operated by a rider to be movable to an acceleration position for providing a forward movement command, a deceleration position for providing a rearward movement command, and a neutral position for providing an idling command, the neutral position being set to a position between the acceleration position and the deceleration position. The first operation section protrudes forward of an axis of the grip and the second operation section protrudes rearward of the axis of the grip. The first operation section and the second operation section are provided on an inner side of the grip, and the tip end of the second operation section is located inward of the tip end of the first operation section in a rightward and leftward direction. The upper end of an operation surface of the second operation section is located below the grip.

6 Claims, 6 Drawing Sheets

PERSONAL WATERCRAFT

CROSS-REFERENCE TO RELATED APPLICATIONS

The present application is a continuation-in-part application that claims the benefit of and priority to U.S. patent application Ser. No. 15/692,710, titled PERSONAL WATERCRAFT, filed Aug. 31, 2017, the entire contents of which is incorporated herein by reference in its entirety for all purposes.

BACKGROUND OF THE INVENTION

Field of the Invention

The present invention relates to a personal watercraft (PWC) which ejects a water jet in a rearward direction by a water jet pump driven by a driving power source mounted in a body, and is steered by a rider gripping a handle bar.

Description of the Related Art

Commonly, a personal watercraft (PWC) is used in leisure, sport or rescue activities. In a typical example of the PWC, an engine is mounted in an inner space of a body defined by a hull and a deck, and a water jet pump is driven by the engine to pressurize and accelerate water suctioned through a water intake provided in the bottom surface of the hull, to eject a water jet in a rearward direction. In this way, the body is moved.

The PWC includes a reverse bucket (reverse gate) which is rotatable between a forward movement position and a rearward movement position. When the reverse bucket stays at the forward movement position, the water jet ejected from the water jet pump flows in the rearward direction and the body moves in a forward direction. When the reverse bucket stays at the rearward movement position, the flow direction of the water jet is changed into the forward direction, and the body moves in the rearward direction, or moves in the forward direction at a reduced speed. In the PWC disclosed in Japanese Laid-Open Patent Application Publication No. 2014-24534, the movement of the reverse bucket is controlled based on the operation amount of a right operation lever attached on a right grip of a handle and the operation amount of a left operation lever attached on a left grip of the handle.

In the PWC having the above-described configuration, it is necessary to provide the pair of operation levers on the right and left sides of a handle bar. In addition, it is necessary to provide position sensors corresponding to the pair of operation levers, respectively, to detect the operation positions of the operation levers. Further, a forward movement state, a rearward movement state, and an idling state of the body are controlled based on two inputs which are the operation amount of the right operation lever and the operation amount of the left operation lever. This makes the control complicated.

SUMMARY OF THE INVENTION

The present invention addresses the above-described problem, and an object of the present invention is to provide a personal watercraft which is capable of controlling a forward movement state, a rearward movement state, and an idling state of a body with a simple configuration.

According to an aspect of the present invention, a personal watercraft comprises a body; a driving power source mounted in the body; a water jet pump driven by the driving power source to eject a water jet in a rearward direction; a handle bar gripped by a rider; a rider operation member provided at a grip on one side of the handle bar, the rider operation member being operated by the rider to be movable to an acceleration position for providing a forward movement command, a deceleration position for providing a rearward movement command, and a neutral position for providing an idling command, the neutral position being set to a position between the acceleration position and the deceleration position in a movement path of the rider operation member; a position sensor which detects an operation position of the rider operation member; and a control unit which controls the driving power source in response to a detection signal of the position sensor, wherein the rider operation member includes a detected section whose position is detected by the position sensor, a first operation section which operates the detected section toward the acceleration position, and a second operation section which operates the detected section toward the deceleration position, wherein the first operation section protrudes forward of an axis of the grip and the second operation section protrudes rearward of the axis of the grip, wherein the first operation section and the second operation section are provided on an inner side of the grip, and a tip end of the second operation section is located inward of a tip end of the first operation section in a rightward and leftward direction, and wherein an upper end of an operation surface of the second operation section is located below the grip.

In accordance with the above-described configuration, the operation surface of the second operation section can be properly pushed by the thumb of the rider's right hand, and the first operation section can be properly pulled by the index finger of the rider's right hand.

DETAILED DESCRIPTION OF THE EMBODIMENTS

Hereinafter, the embodiment of the present invention will be described with reference to the accompanying drawings. The stated directions are from the perspective of a rider riding a personal watercraft.

Embodiment 1

Figure 1:
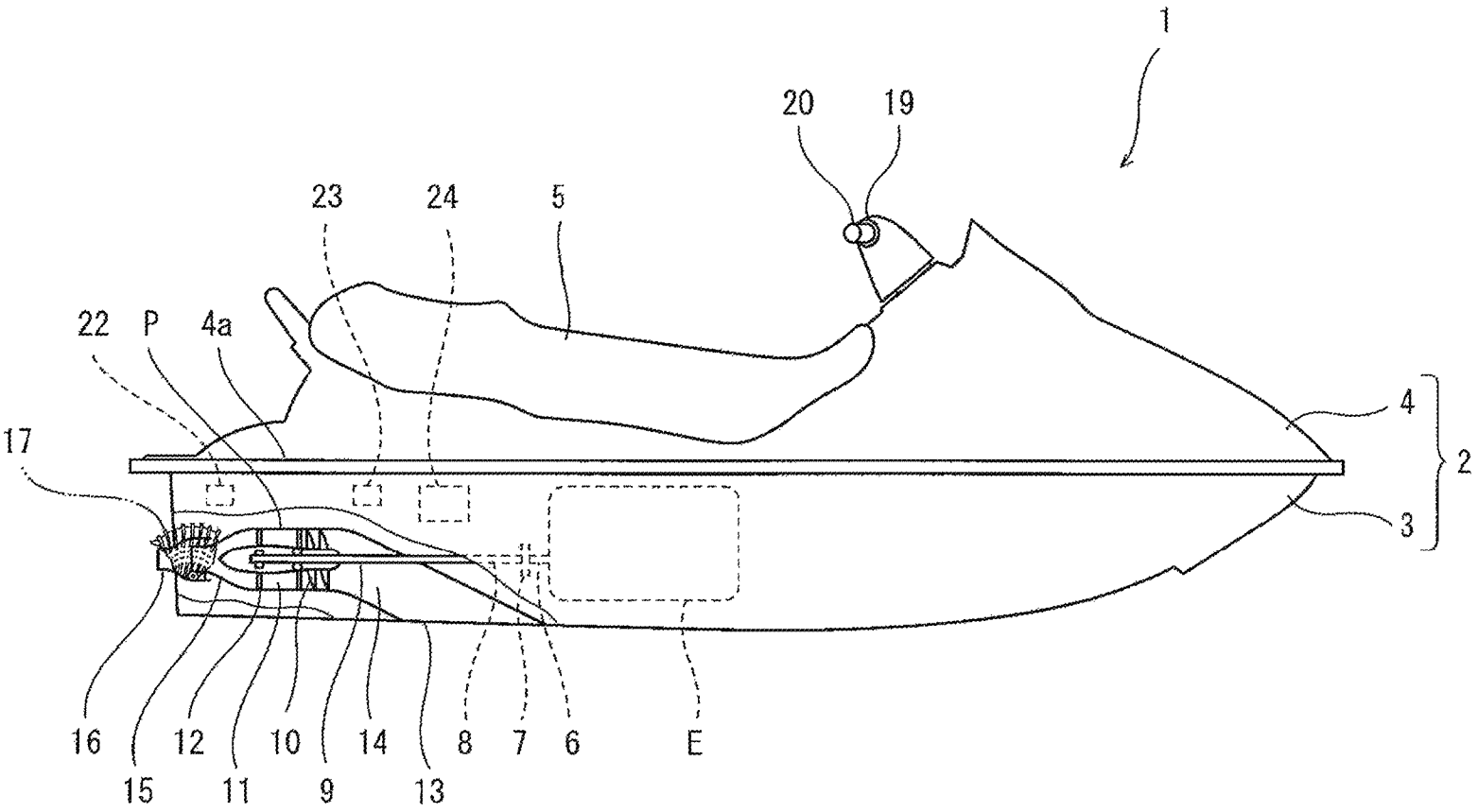
FIG. 1 is a side view of a personal watercraft according to Embodiment 1, which is partially cut away.

FIG. 1 is a side view of a personal watercraft 1 according to Embodiment 1, which is partially cut away. Referring now to FIG. 1, the personal watercraft 1 includes a body 2 including a hull 3 and a deck 4 covering the upper portion of the hull 3. The personal watercraft 1 is a seat-type personal watercraft in which the body 2 is provided with a seat 5 which can be straddled by the rider. Alternatively, the personal watercraft 1 may be a stand-up type personal watercraft. A deck floor 4*a* on which the rider's feet are rested is provided at the rear portion of the deck 4. An engine E as a driving power source is accommodated in the inner space of the body 2.

An output shaft 6 (crankshaft) of the engine E extends rearward in the body 2. The end portion of the output shaft 6 from which engine power of the engine E is output is coupled to a propeller shaft 8 via a coupling member 7. A water jet pump P is disposed at a center in a rightward and leftward direction, of the rear portion of the hull 3. The propeller shaft 8 is connected to a pump shaft 9 of a water jet pump P. In this configuration, the pump shaft 9 rotates in association with the rotation of the output shaft 6. An impeller 10 is attached on the pump shaft 9. A fairing vane 11 is disposed behind the impeller 10. A tubular pump casing 12 is provided at the outer periphery of the impeller 10 to cover the impeller 10.

A water intake 13 is open in the bottom portion of the body 2. The water intake 13 and the pump casing 12 are in communication with each other via a water passage 14. A pump nozzle 15 is provided at the rear portion of the body 2 and connected to the pump casing 12. The pump nozzle 15 has a diameter reduced in a rearward direction. An ejection port is open in the rear end of the pump nozzle 15. A steering nozzle 16 is connected to the ejection port of the pump nozzle 15 in such a manner that the steering nozzle 16 is pivotable to the right and to the left.

In the personal watercraft 1 configured as described above, the water jet pump P is driven by the engine E, and the water suctioned through the water intake 13 provided in the bottom portion of the hull 3 is pressurized and accelerated by the rotational force of the impeller 10. This water flow is faired by the fairing vane 11, and a water jet is swiftly ejected in the rearward direction from the ejection port of the pump nozzle 15 through the steering nozzle 16. By the reaction of the water jet ejected from the water jet pump P through the steering nozzle 16, the personal watercraft 1 gains a propulsive force for moving the body 2.

A steering handle bar 19 is disposed at the front portion of the deck floor 4*a*. The handle bar 19 can be gripped by the rider. A rider operation member 21 (see FIG. 3) which will be described in detail later is provided on a right grip 20 of the handle bar 19. The rider operation member 21 can be operated by the rider. The handle bar 19 is connected to the steering nozzle 16 via a steering cable (not shown). The steering nozzle 16 is pivotable to the right or to the left in association with a motion of the handle bar 19 which is tiltable to the right and to the left.

A reverse bucket 17 with a bowl shape is disposed in the vicinity of the steering nozzle 16. The reverse bucket 17 is rotatable around a rotational axis extending in the rightward and leftward direction. A reverse bucket actuator 22 (e.g., motor) actuates the reverse bucket 17. The reverse bucket 17 is rotatable between a forward movement position at which the reverse bucket 17 is located on the upper side of the steering nozzle 16, and the whole of the ejection port of the steering nozzle 16 is opened in the rearward direction, and a rearward movement position at which the reverse bucket 17 is located on the lower side of the steering nozzle 16, and the whole of the ejection port of the steering nozzle 16 is covered by the reverse bucket 17 from the rear. As shown in FIG. 1, the reverse bucket 17 stays at the forward movement position where the ejection port of the steering nozzle 16 is opened when viewed from the rear. In a state in which the reverse bucket 17 stays at the forward movement position, the water jet ejected from the steering nozzle 16 is flowed in the rearward direction, and thus the body 2 is moved in the forward direction. When the reverse bucket 17 is rotated to and stays at the rearward movement position where the ejection port of the steering nozzle 16 is covered by the reverse bucket 17 from the rear, the flow direction of the water jet ejected from the steering nozzle 16 is changed into the forward direction, and thus the body 2 is moved in the rearward direction.

A neutral position of the reverse bucket 17 is set to a position between the forward movement position and the rearward movement position, in a movement path of the reverse bucket 17. In a state in which the reverse bucket 17 stays at the neutral position, the reverse bucket 17 covers the upper portion of the ejection port of the steering nozzle 16 from the rear, and the lower portion of the ejection port of the steering nozzle 16 is opened (exposed) in the rearward direction. In a state in which the reverse bucket 17 stays at the neutral position, the reverse bucket 17 changes the flow direction of a part of the water jet ejected from the steering nozzle 16 into a downward direction, while another part of the water jet ejected from the steering nozzle 16 flows in the rearward direction through a region that is below the reverse bucket 17. In summary, in a state in which the reverse bucket 17 stays at the neutral position, it is difficult for the water jet ejected from the steering nozzle 16 to contribute to the forward movement or rearward movement of the body 2. In this state, the body 2 is kept in a stationary state.

A reverse bucket controller 23 is mounted in the body 2 to control the reverse bucket actuator 22. A control unit 24 is mounted in the body 2 to control the engine E and transmit a control signal to the reverse bucket controller 23. Each of the reverse bucket controller 23 and the control unit 24 includes a processor, a volatile memory, a non-volatile memory, an I/O interface, and the like. The processor performs computation on the volatile memory based on a program stored in the non-volatile memory, in response to a signal input via the I/O interface, and outputs the control signal via the I/O interface. Alternatively, the reverse bucket controller 23 may be integrated with the control unit 24.

Figure 2:
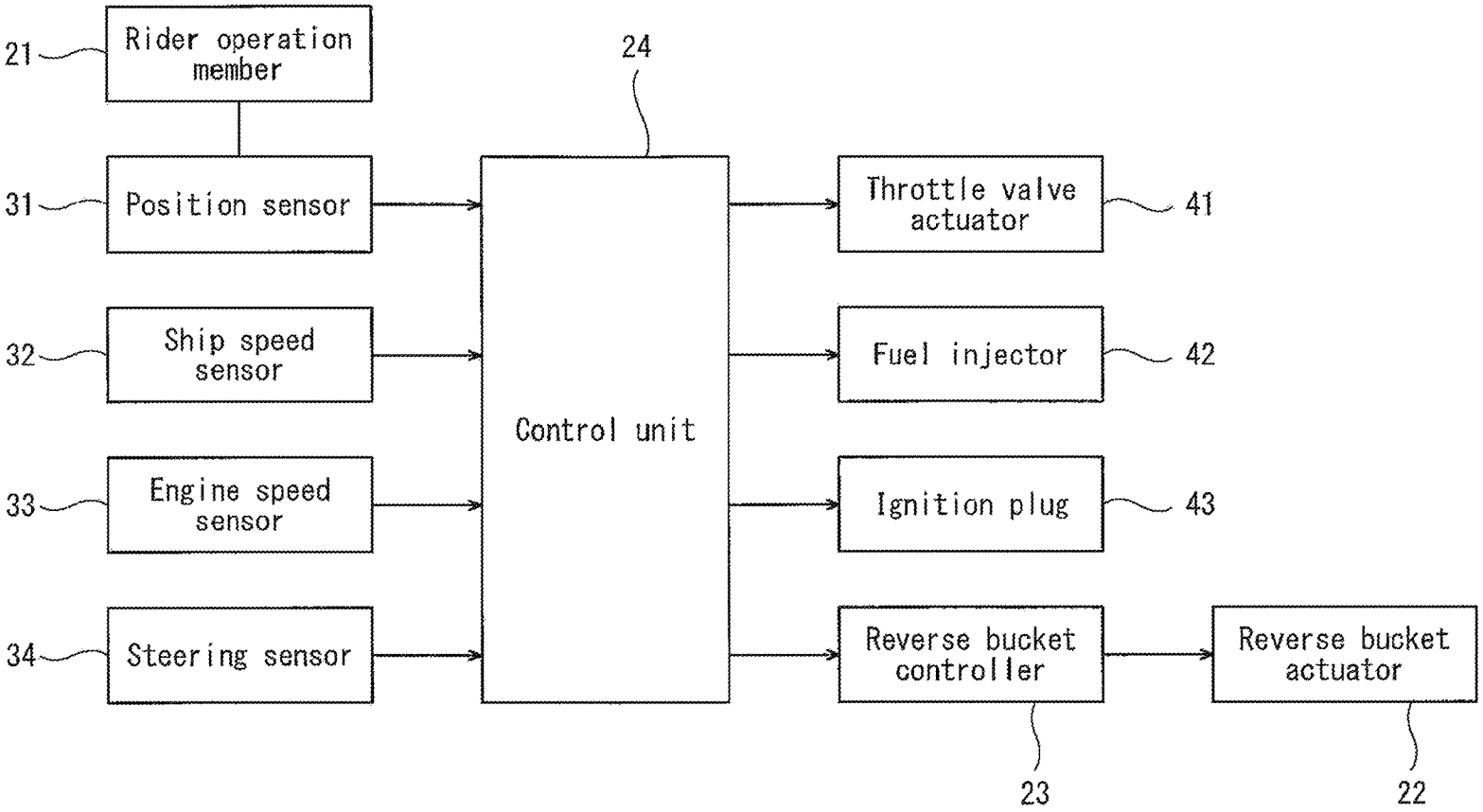
FIG. 2 is a block diagram of a control system of the personal watercraft of FIG. 1.

FIG. 2 is a block diagram of a control system of the personal watercraft 1 of FIG. 1. Referring to FIG. 2, a position sensor 31, a ship speed sensor 32, an engine speed sensor 33, and a steering sensor 34 are connected to the input side of the control unit 24. The position sensor 31 is attached on the handle bar 19 and configured to detect an operation position TH (operation amount) of the rider operation member 21. The ship speed sensor 32 is configured to detect a traveling speed V of the body 2. The ship speed sensor 32 may estimate the ship speed from an integration amount of an engine speed for a latest specified time period, calculate the ship speed from a displacement of the position of the personal watercraft 1 which is detected by a GPS sensor, or a water jet speed sensor which detects the rotational speed of a water wheel rotated by the water flow surrounding the body 2 with a rotational speed sensor and calculate the ship speed.

The engine speed sensor 33 is configured to detect a rotational speed R of the output shaft 6 of the engine E. The steering sensor 34 is configured to detect a steering angle θ of the handle bar 19. It is sufficient that the steering sensor 34 is capable of determining whether at least a steering angle θ of the handle bar 19 is equal to or greater than a threshold $\theta_a$. For example, the steering sensor 34 may be a switch configured to output an ON signal when the steering angle θ is equal to or greater than the threshold $\theta_a$ and cease to output the ON signal when the steering angle θ is less than the threshold $\theta_a$.

A throttle valve actuator 41, a fuel injector 42, an ignition plug 43, and the reverse bucket controller 23 are connected to the output side of the control unit 24. The throttle valve actuator 41 is configured to drive a throttle valve to adjust a throttle valve opening degree of a throttle device which is in communication with an intake port of the engine E. The fuel injector 42 is configured to inject fuel to intake air of the engine E. The ignition plug 43 is configured to ignite an air-fuel mixture in a combustion chamber of the engine E. In brief, the throttle valve actuator 41, the fuel injector 42 and the ignition plug 43 are controlled, and thus the engine power of the engine E is controlled.

Figure 3:
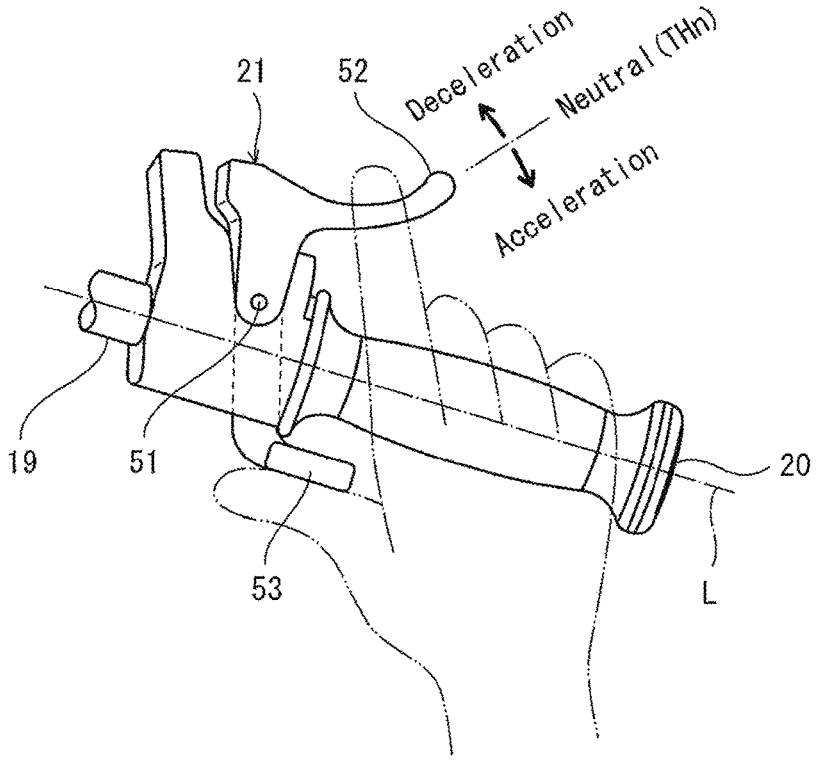
FIG. 3 is a plan view showing a rider operation member operated by a rider and a region which is in the vicinity of the rider operation member, in the personal watercraft of FIG. 1.
Figure 4:
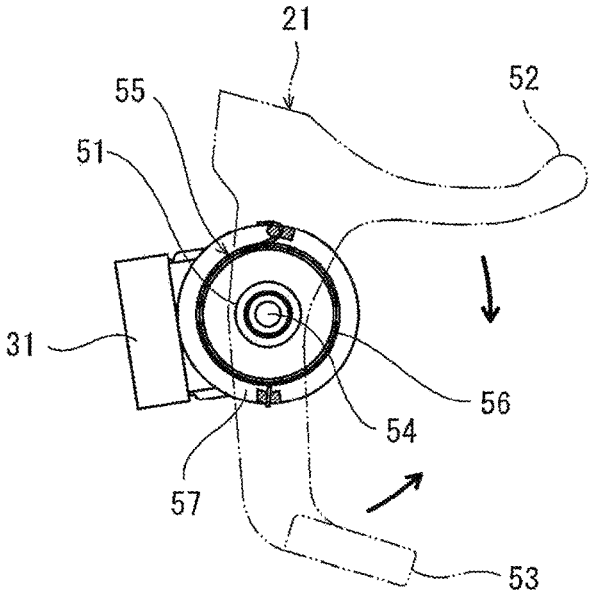
FIG. 4 is a view showing a biasing mechanism for biasing the rider operation member of FIG. 3.

FIG. 3 is a plan view showing the rider operation member 21 operated by the rider and a region which is in the vicinity of the rider operation member 21, in the personal watercraft 1 of FIG. 1. FIG. 4 is a view showing a biasing mechanism 55 for biasing the rider operation member 21 of FIG. 3. As shown in FIGS. 3 and 4, the rider operation member 21 includes a detected section 51, a first operation section 52 and a second operation section 53. The detected section 51 is rotatable around a rotation support shaft 54. The position sensor 31 attached on the handle bar 19 is configured to detect the position (angle) of the detected section 51. The first operation section 52 and the second operation section 53 are disposed at different positions. The first operation section 52 is connected to the detected section 51. The first operation section 52 is operated by a finger of the rider to rotate the detected section 51 toward an acceleration position. The second operation section 53 is connected to the detected section 51. The second operation section 53 is operated by another finger of the rider to rotate the detected section 51 toward a deceleration position. In brief, the position sensor 31 detects the movement of the first operation section 52 and the movement of the second operation section 53.

Specifically, the detected section 51 of the rider operation member 21 is disposed inward of the grip 20 of the handle bar 19 (closer to a center in the rightward and leftward direction). The first operation section 52 protrudes forward of an axis L of the grip 20 from the detected section 51. The first operation section 52 is a first lever pulled (drawn) by the index finger of the rider's right hand. The second operation section 53 protrudes rearward of the axis L of the grip 20 from the detected section 51. The second operation section 53 is a second lever which can be pushed by the thumb of the rider's right hand. The first operation section 52 and the second operation section 53 are integrated with each other with the detected section 51 interposed between the first operation section 52 and the second operation section 53. When one of the first operation section 52 and the second operation section 53 is operated and moved by the rider, the other of the first operation section 52 and the second operation section 53 is moved according to the movement of one of the first operation section 52 and the second operation section 53.

The rider operation member 21 is movable to an acceleration position (pull operation position of the first operation section 52) for providing a forward movement command, a deceleration position (push operation position of the second operation section 53) for providing a rearward movement command, and a neutral position for providing an idling command, the neutral position being set to a position between the acceleration position and the deceleration position in a movement path of the rider operation member 21. The rider operation member 21 is biased by the biasing mechanism 55 toward a neutral position $TH_n$. In the present embodiment, the basing mechanism 55 includes a torsion spring 56. A first end portion of the torsion spring 56 is engaged with the rider operation member 21. A second end portion of the torsion spring 56 is engaged with a mount 57 fastened to the handle bar 19. In a state in which the torsion spring 56 has a natural length, the rider operation member 21 is at the neutral position $TH_n$. When the first operation section 52 is pulled (drawn) by the rider, the torsion spring 56 is compressed, while when the second operation section 53 is pushed by the rider, the torsion spring 56 is extended. In a case where a maximum deceleration position of the operation position TH (opening degree) of the rider operation member 21 is expressed as 0% and a maximum acceleration position of the operation position TH (opening degree) is expressed as 100%, the neutral position $TH_n$ is set to a position which is less than 50%. For example, the neutral position $TH_n$ is set to a position which is equal to or greater than 20% and less than 40%.

Figure 5:
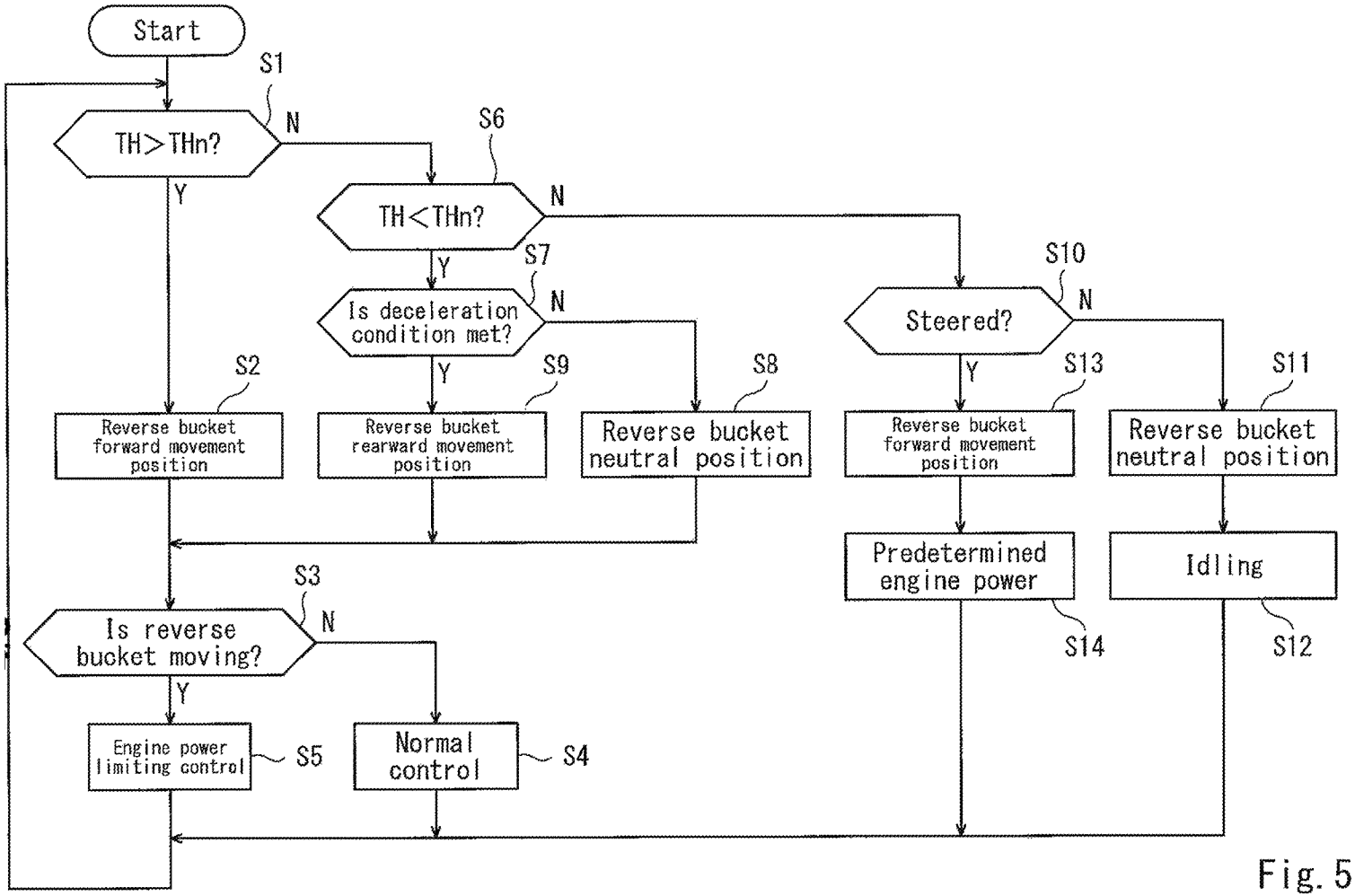
FIG. 5 is a flowchart showing a control operation of the personal watercraft of FIG. 2.
Figure 6:
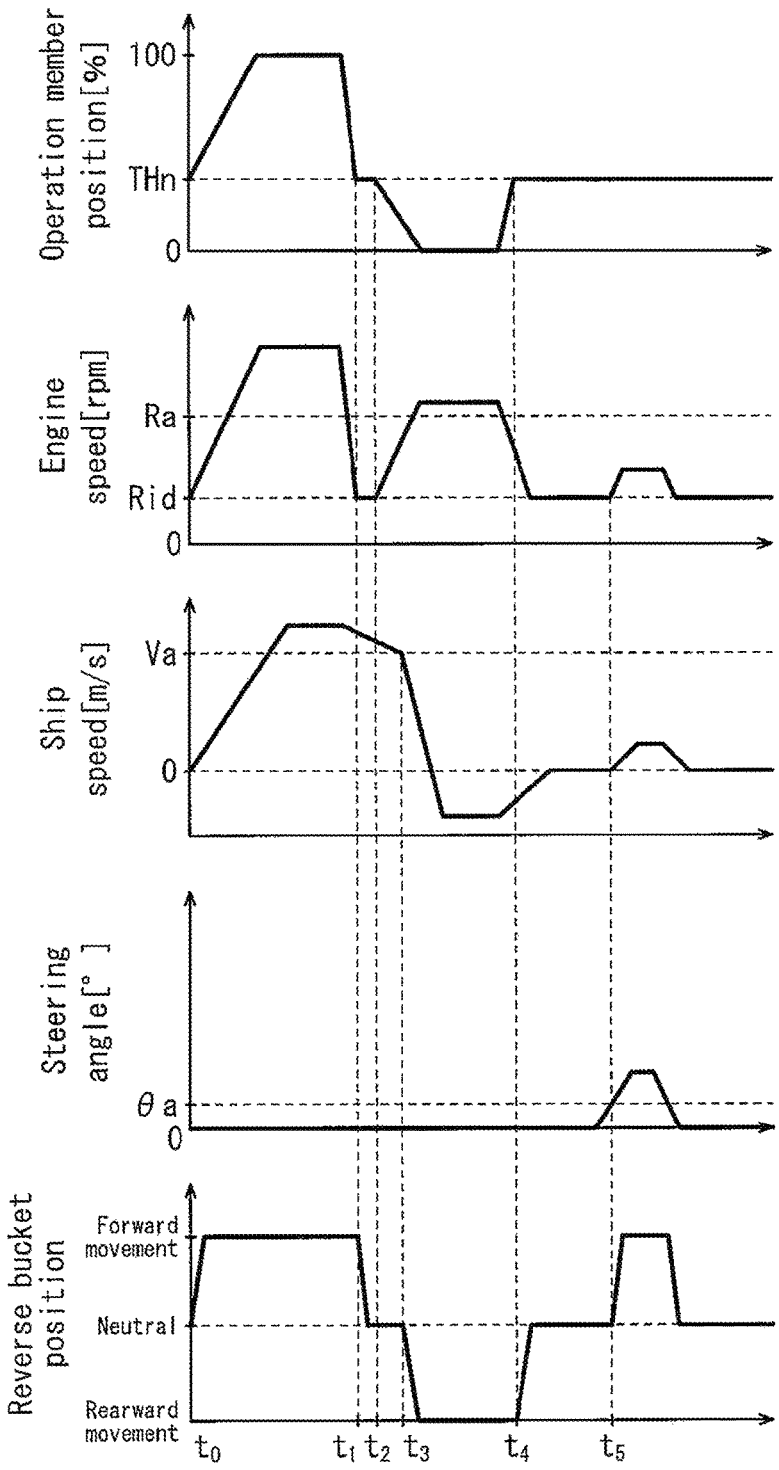
FIG. 6 is a timing chart showing the control operation of the personal watercraft of FIG. 2.

FIG. 5 is a flowchart showing a control operation of the personal watercraft 1 of FIG. 2. FIG. 6 is a timing chart showing the control operation of the personal watercraft 1 of FIG. 2. Hereinafter, the control operation will be described with reference to FIG. 2 or the like, along the flow of the charts of FIGS. 5 and 6. Initially, the control unit 24 determines whether or not the operation position TH detected by the position sensor 31 is greater than the neutral position $TH_n$ (whether or not the first operation section 52 has been pulled (drawn) toward the acceleration position) (step S1). In a case where the control unit 24 determines that the operation position TH is greater than the neutral position $TH_n$ (Step S1: Yes), the control unit 24 causes the reverse bucket controller 23 to drive the reverse bucket actuator 22, to move the reverse bucket 17 to the forward movement position (step S2: time $t_0$).

Then, the control unit 24 communicates with the reverse bucket controller 23 and determines whether or not the reverse bucket 17 is moving (step S3). In a case where the control unit 24 determines that the reverse bucket 17 is not moving (step S3: No), the control unit 24 performs a normal control for increasing engine power of the engine E in response to the operation amount of the rider operation member 21 from the neutral position $TH_n$. Specifically, in the normal control, the control unit 24 controls the throttle valve actuator 41, the fuel injector 42 and the ignition plug 43 so that the engine power increases in proportion to an absolute value ($|TH-TH_n|$) of a difference between the present position and neutral position $TH_n$ of the rider operation member 21. In a case where the control unit 24 determines that the reverse bucket 17 is moving (step S3: Yes), the control unit 24 performs an engine power limiting control for limiting the engine power so that the engine power becomes less than the engine power in the normal control (step S5). In the engine power limiting control, the control unit 24 may reduce the upper limit of the engine speed, or control the engine E by use of an engine power command value obtained by reducing the engine power command value in the normal control with a predetermined ratio. In either the normal control or the engine power limiting control, in a case where the control unit 24 determines that the operation position TH is greater than the neutral position $TH_n$, the engine power of the engine E becomes greater than idling power.

Then, in a case where the control unit 24 determines that the operation position TH is equal to or less than the neutral position $TH_n$ (pulling (drawing) of the first operation section 52 is ceased) (Step S1: No), the control unit 24 determines whether or not the operation position TH is less than the neutral position $TH_n$ (the second operation section 53 has been pushed by the rider) (step S6). In a case where the control unit 24 determines that the operation position TH is equal to the neutral position $TH_n$ (step S6: No), the control unit 24 determines whether or not a steering angle θ is greater than (has exceeded) a threshold $\theta_a$ (step S10). In a case where the control unit 24 determines that the steering angle θ is equal to or less than the threshold $\theta_a$ (step S10: No), the control unit 24 causes the reverse bucket controller 23 to drive the reverse bucket actuator 22, to move the reverse bucket 17 to the neutral position, and causes the engine speed R to reach an idling engine speed $R_{id}$ (step S11: time $t_1$).

Then, in a case where the control unit 24 determines that the operation position TH is less than the neutral position $TH_n$ (the second operation section 53 has been pushed) (step S6: Yes), the control unit 24 determines whether or not a predetermined deceleration condition is met (step S7). This deceleration condition includes a condition in which a traveling speed V detected by the ship speed sensor 32 is lower than a threshold $V_a$ and a condition in which the engine speed R detected by the engine speed sensor 33 is lower than a threshold $R_a$. In a case where the deceleration condition is met, the reverse bucket 17 can be moved in a state in which an excessively high resistance is not applied by the water jet to the reverse bucket 17. Note that the threshold $V_a$ is greater than zero and the threshold $R_a$ is greater than the idling engine speed $R_{id}$.

In a case where the control unit 24 determines that the deceleration condition is not met (Step S7: No), the control unit 24 maintains the reverse bucket 17 at the neutral position (step S8: time $t_2$). On the other hand, in a case where the control unit 24 determines that the deceleration condition is met (Step S7: Yes), the control unit 24 causes the reverse bucket controller 23 to drive the reverse bucket actuator 22 to move the reverse bucket 17 to the rearward movement position (step S9: time $t_3$). During the rearward movement, the above-described steps S3 to S5 are performed as in the forward movement. In a case where the control unit 24 determines that the operation position TH is less than the neutral position $TH_n$ (step S6: Yes), the condition in which the engine speed R is lower than the threshold $R_a$ is met, and the condition in which the traveling speed V is lower than the threshold $V_a$ is not met, the control unit 24 maintains the engine speed R at a value lower than the threshold $R_a$ until the condition in which the traveling speed V is lower than the threshold $V_a$ is met.

Then, in a case where the control unit 24 determines that the operation position TH is equal to the neutral position $TH_n$ (step S1 and S6: No) and determines that the steering angle θ is greater than (has exceeded) the threshold $\theta_a$ (step S10: Yes), the control unit 24 causes the reverse bucket controller 23 to drive the reverse actuator 22, to move the reverse bucket 17 to the forward movement position (step S13), and controls the throttle valve actuator 41, the fuel injector 42, and the ignition plug 43 so that the engine speed R reaches a predetermined engine speed higher than the idling engine speed $R_{id}$ (step S14: time $t_5$).

In accordance with the above-described configuration, since the neutral position $TH_n$ for providing the idling command is set to the position between the acceleration position for providing the forward movement command and the deceleration position for providing the rearward movement command, in the movement of path of the rider operation member 21, the engine E becomes the idling state at a time point while the rider operation member 21 is operated and moved by the rider from the acceleration position to the deceleration position. In this configuration, the control unit 24 may control the forward movement state, the rearward movement state and the idling state of the body 2, in response to the rider's operation for moving the rider operation member 21. Therefore, the configuration and control can be simplified.

Since the engine E becomes the idling state at a time point while the rider operation member 21 is operated and moved by the rider from the acceleration position to the deceleration position, the ejection force of the water jet ejected from the water jet pump P is reduced while the reverse bucket 17 is moving from the acceleration position to the deceleration position by way of the neutral position $TH_n$. This makes it possible to prevent a situation in which the reverse bucket 17 becomes unmovable due to a swift water jet or a situation in which the reverse bucket 17 is damaged by the swift water jet.

In a state in which the rider operation member 21 is at the neutral position $TH_n$, the ejection force of the water jet ejected from the water jet pump P can be reduced to allow the reverse bucket 17 to easily move. In addition, in a state in which the rider operation member 21 is at the acceleration position or the deceleration position, a force for moving the body 2 in the forward direction or a force for moving the body 2 in the rearward direction can be properly generated.

In a case where the rider operation member 21 is operated and moved by the rider to the deceleration position and the traveling speed V of the body 2 is equal to or higher than the threshold $V_a$, the reverse bucket 17 moves to the neutral position $TH_n$. For this reason, in a case where the traveling speed V of the body 2 is equal to or higher than the threshold $V_a$, and the water surrounding the body 2 may contact the reverse bucket 17 at a high speed, the reverse bucket 17 does not move to the rearward movement position even when the rider operation member 21 is operated and moved by the rider to the deceleration position. This makes it possible to prevent a situation in which a high load is applied from the water surrounding the body 2 to the reverse bucket 17 which is moving.

In a case where the control unit 24 determines that the reverse bucket 17 is moving, the engine power limiting control for limiting the engine power so that the engine power becomes less than the engine power in the normal control is performed. This makes it possible to prevent a situation in which a swift water jet contacts the reverse bucket 17 which is moving, just after the rider's operation for moving the rider operation member 21 from the neutral position $TH_n$ toward the acceleration position or the deceleration position has started.

The rider operation member 21 includes the first operation section 52 operated by the rider to rotate the detected section 51 whose position is detected by the position sensor 31 toward the acceleration position, and the second operation section 53 operated by the rider to rotate the detected section 51 toward the deceleration position. Therefore, the rider can perform the acceleration operation and the deceleration operation without a confusion between them.

The first operation section 52 is disposed in front of the grip 20 of the handle bar 19, and the second operation section 53 is disposed rearward of the grip 20. In this arrangement, the rider can operate the first operation section 52 with the index finger of the hand gripping the grip 20 of the handle bar 19 and operate the second operation section 53 with the thumb of the handle gripping the grip 20.

Embodiment 2

Figure 7:
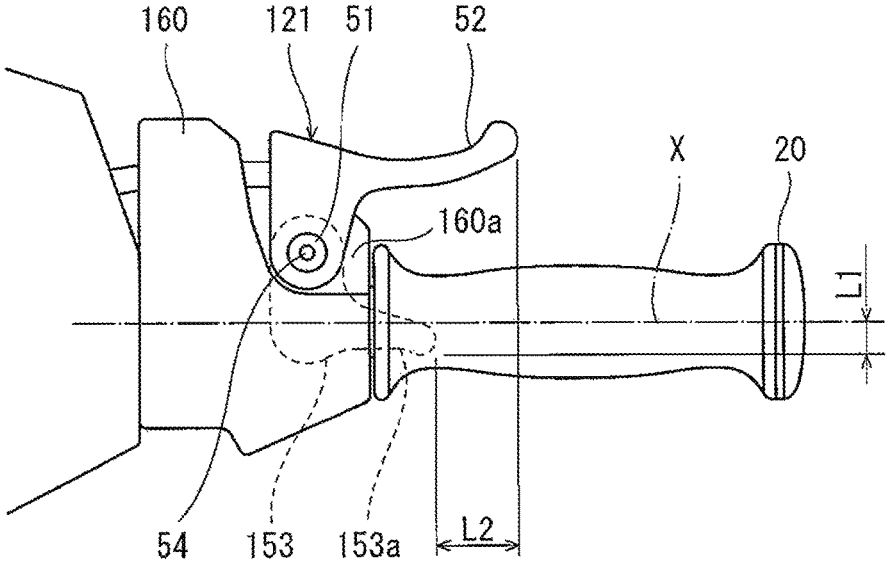
FIG. 7 is a plan view of a rider operation member of a personal watercraft according to Embodiment 2, and a region that is in the vicinity of the rider operation member.
Figure 8:
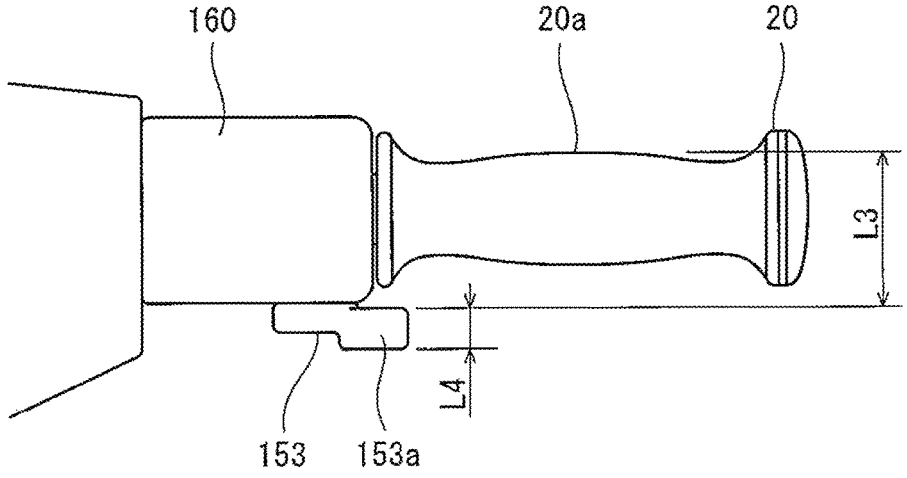
FIG. 8 is a rear view of the rider operation member of the personal watercraft of FIG. 7, and a region that is in the vicinity of the rider operation member.

A. FIG. 7 is a plan view of a rider operation member 121 of a personal watercraft according to Embodiment 2, and a region that is in the vicinity of the rider operation member 121. FIG. 8 is a rear view of the rider operation member 121 of the personal watercraft of FIG. 7, and a region that is in the vicinity of the rider operation member 121.

In FIGS. 7 and 8, the same constituents as those of Embodiment 1 are designated by the same reference symbols and will not be described in repetition. As shown in FIGS. 7 and 8, the rider operation member 121 includes the detected section 51, the first operation section 52, and a second operation section 153, and the rider operation member 121 is provided at a handle base part 160 which is adjacent to the inner side of the grip 20 (the handle base part 160 is located closer to a center in the rightward and leftward direction than the grip 20).

The second operation section 153 protrudes rearward of an axis X of the grip 20 from the detected section 51. An operation surface 153*a* facing in the rearward direction, of the second operation section 153, which can be pushed by the thumb of the rider's right hand, is located rearward of the axis X and forward of the rear surface of the grip 20. Specifically, a distance L1 in the forward and rearward direction, between the operation surface 153*a* of the second operation section 153 and the axis X is set to 20 mm or less. The tip end of the second operation section 153 is located more inward (closer to the center in the rightward and leftward direction) than the tip end of the first operation section 52. Specifically, a distance L2 in the rightward and leftward direction between the tip end of the second operation section 153 and the tip end of the first operation section 52 is set to 45 mm or less.

The upper end of the operation surface 153*a* of the second operation section 153 is located below the grip 20. Specifically, a distance L3 between the upper end of the operation surface 153*a* of the second operation section 153 and the upper end of a gripping part 20*a* of the grip 20 is set to a value in a range of 20 to 60 mm. A vertical dimension L4 of the operation surface 153*a* of the second operation section 153 is set to 8 mm or more. The first operation section 52 is hidden by the grip 20 from the rear.

In accordance with the above-described configuration, the operation surface 153*a* of the second operation section 153 can be properly pushed by the thumb of the rider's right hand. In addition, when the first operation section 52 is pulled by the index finger of the rider's right hand, the first operation section 52 does not contact the long (middle) finger of the rider's right hand. The other constituents are the same as those of Embodiment 1 described above, and will not be described in repetition.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims. For example, an electric motor may be used instead of the engine, as the driving power source. Further, the second operation section 53 may be used to accelerate the body 2 and the first operation section 52 may be used to decelerate the body 2.

The invention claimed is:

1. A personal watercraft comprising:

a body;

a driving power source mounted in the body;

a water jet pump driven by the driving power source to eject a water jet in a rearward direction;

a handle bar gripped by a rider;

a rider operation member provided at a grip on one side of the handle bar, the rider operation member being operated by the rider to be movable to an acceleration position for providing a forward movement command, a deceleration position for providing a rearward movement command, and a neutral position for providing an idling command, the neutral position being set to a position between the acceleration position and the deceleration position in a movement path of the rider operation member;

a position sensor which detects an operation position of the rider operation member; and a control unit which controls the driving power source in response to a detection signal of the position sensor, wherein the rider operation member includes a detected section whose position is detected by the position sensor, a first operation section which operates the detected section toward the acceleration position, and a second operation section which operates the detected section toward the deceleration position, wherein the first operation section protrudes forward of an axis of the grip and the second operation section protrudes rearward of the axis of the grip, wherein the first operation section and the second operation section are provided on an inner side of the grip, and a tip end of the second operation section is located inward of a tip end of the first operation section in a rightward and leftward direction, and wherein an upper end of an operation surface of the second operation section is located below the grip.

2. The personal watercraft according to claim 1, wherein the operation surface of the second operation section is located rearward of the axis of the grip and forward of a rear surface of the grip.

3. The personal watercraft according to claim 1, wherein the rider operation member is biased by a biasing mechanism toward the neutral position.

4. The personal watercraft according to claim 1, further comprising:

a reverse bucket which is movable to a forward movement position at which the water jet ejected from the water jet pump is flowed in a rearward direction to move the body in a forward direction, a rearward movement position at which a flow direction of the water jet ejected from the water jet pump is changed into the forward direction to move the body in the rearward direction, and a neutral position set between the forward movement position and the rearward movement position, wherein the reverse bucket moves to the forward movement position in response to the rider's operation for moving the rider operation member to the acceleration position, moves to the rearward movement position in response to the rider's operation for moving the rider operation member to the deceleration position, and moves to the neutral position in response to the rider's operation for moving the rider operation member to the neutral position.

5. The personal watercraft according to claim 4, wherein the control unit controls the driving power source so that power of the driving power source becomes idling power, in response to the rider's operation for moving the rider operation member to the neutral position, and wherein the control unit controls the driving power source so that the power of the driving power source becomes greater than the idling power, in response to the rider's operation for moving the rider operation member to the acceleration position and the rider's operation for moving the rider operation member to the deceleration position.

6. The personal watercraft according to claim 4, further comprising:

a ship speed sensor which detects a traveling speed of the body; and an actuator which actuates the reverse bucket, wherein the control unit causes the actuator to move the reverse bucket to the neutral position, in a case where the rider operation member is operated and moved by the rider to the deceleration position and the traveling speed is equal to or higher than a predetermined threshold, and wherein the control unit causes the actuator to move the reverse bucket to the rearward movement position, in a case where the rider operation member is operated and moved by the rider to the deceleration position and the traveling speed is lower than the predetermined threshold.

* * * * *